US005275542A

United States Patent [19]

Terauchi

[11] Patent Number: 5,275,542

[45] Date of Patent: Jan. 4, 1994

[54] FREE PISTON-TYPE COMPRESSOR

[75] Inventor: Kiyoshi Terauchi, Isesaki, Japan

[73] Assignee: Sanden Corporation, Gunma, Japan

[21] Appl. No.: 868,858

[22] Filed: Apr. 16, 1992

[30] Foreign Application Priority Data

Apr. 16, 1991 [JP] Japan ..... 3-033841[U]

[51] Int. Cl.[5] ..... F04B 17/04

[52] U.S. Cl. ..... 417/417; 417/340

[58] Field of Search ..... 417/417, 416, 340

[56] References Cited

U.S. PATENT DOCUMENTS

| | | | |
|---|---|---|---|
| 3,145,660 | 8/1964 | Bush | 417/340 |
| 4,002,935 | 1/1977 | Bauer | 417/416 |
| 4,090,816 | 5/1978 | Takahashi | 417/417 |
| 4,781,546 | 11/1988 | Curwen | 417/417 |
| 4,836,757 | 6/1989 | Curwen et al. | 417/416 |

*Primary Examiner*—Richard A. Bertsch

*Assistant Examiner*—Alfred Basichas

*Attorney, Agent, or Firm*—Baker & Botts

[57] ABSTRACT

A free piston type compressor includes a piston slidably fitted within a cylinder. A compression chamber is defined in the cylinder on one side of the piston, and a balance chamber is defined in the cylinder on the other side of the piston. A piston rod is connected to the piston and axially extends out of the cylinder through the balance chamber. A valve mechanism includes a suction valve, a discharge valve, and a valve plate, and is disposed on the end portion of the cylinder that faces the compression chamber. Since the piston rod extends out of the cylinder without passing through the compression chamber, the seal between the cylinder and the piston rod is not subjected to the high pressure working fluid, and the volumetric efficiency of the compressor is increased by reducing the dead clearance in the compression chamber.

19 Claims, 1 Drawing Sheet

FREE PISTON-TYPE COMPRESSOR

TECHNICAL FIELD

The present invention relates to a free piston-type linear resonant reciprocating machine, and more particularly, the relative arrangement of the compression chamber and the balance chamber therein.

BACKGROUND OF THIS INVENTION

U.S. Pat. Nos. 4,781,546 and 4,836,757 to Curwen, both of which are hereby incorporated by reference, disclose a conventional free piston-type compressor having a piston reciprocally fitted within a cylinder. An electromagnetic motor reciprocates the piston within the cylinder, and as the piston reciprocates, working fluid is compressed on both sides of the piston. A piston rod extending through the compression chamber has one of its ends connected to the piston member. A balance chamber is disposed opposite to the compression chamber relative to the piston. As the piston reciprocates, its inertia is balanced by the recoil strength of a coil spring acting on one side thereof and by the compression load of the balance chamber acting on the other side thereof.

Since the compression chamber is disposed on the side of the piston chamber through which the piston rod extends, there is a resulting reduction in the total volume of the compression chamber. Consequently, the volumetric efficiency of the compressor is reduced. Moreover, the high pressure in the compression chamber must be contained and sealed by, among other things, a seal disposed around the reciprocating piston rod. Since the seal abuts the piston rod, and is, therefore, subjected to reciprocating movement, it must be suitably designed to withstand a relatively harsh environment in addition to the high pressure of the compression chamber.

Furthermore, the arrangement of the valve mechanism, which includes a valve plate, suction and discharge holes, and suction and discharge valves, must accommodate the piston rod extending therethrough. Accordingly, the arrangement of the valve mechanism is limited.

SUMMARY OF THE INVENTION

It is an object of the preferred embodiment to provide a free piston-type compressor in which the seal between the connecting rod and the cylinder is not subjected to the high pressure working fluid.

It is another object of the preferred embodiment to improve the volumetric efficiency of a free piston-type compressor by reducing the dead clearance of the compression chamber.

It is still another object of the preferred embodiment to provide a free piston-type compressor in which the design of the valve mechanism is not constrained by the connecting rod.

A free piston type compressor according to the preferred embodiment includes a piston slidably fitted within a cylinder. A working gas compression chamber is defined on one side of the piston, while a balance chamber is defined on the other side of the piston. A piston rod connected to the piston axially extends out of the cylinder through the balance chamber. A valve mechanism, which includes a suction valve, a discharge valve, and a valve plate, is disposed on and closes an upper end portion of the cylinder. As the motor reciprocates the piston rod, the piston compresses the working fluid within the cylinder.

Since the compression chamber is disposed on the side opposite to the piston rod relative to the piston, the seal between the piston rod and the cylinder is not subjected to the relatively high pressure working fluid. Consequently, the potential for leakage of working fluid is reduced. Additionally, the valve mechanism need not account for a piston rod extending therethrough. Finally, since the working chamber of the cylinder does not have the piston rod extending therethrough, the volumetric efficiency of the compressor is increased.

Further objects, features and other advantages of the preferred embodiment will be understood from the following detailed description when read in conjunction with the accompanying drawing.

DETAILED DESCRIPTION OF THE PREFERRED EMBODIMENT

Figure 1:
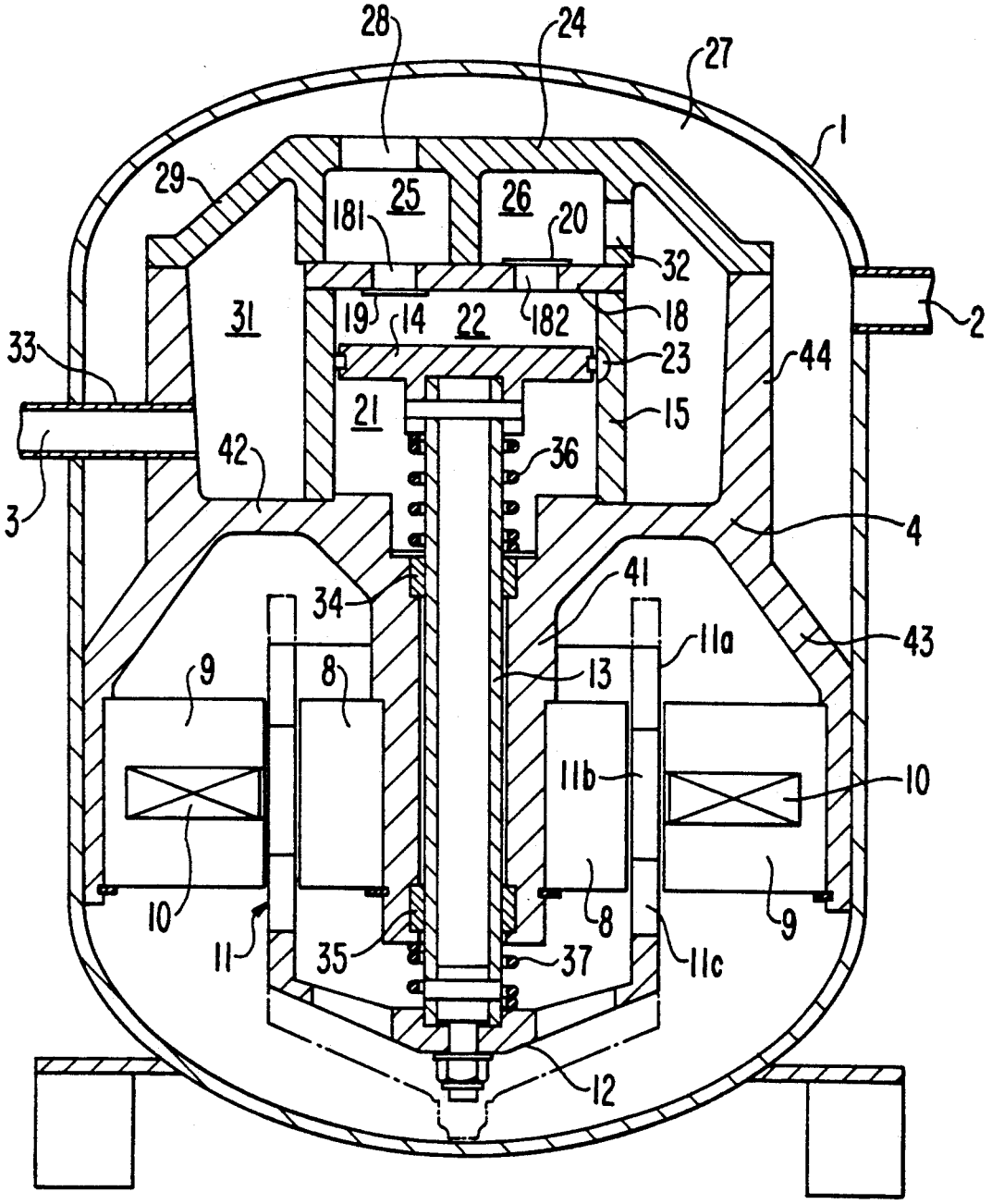
FIG. 1 is a cross-sectional view of a free piston-type compressor in accordance with one preferred embodiment.

With reference to FIG. 1, the construction of a free piston-type compressor in accordance with the preferred embodiment is shown. The free piston-type compressor includes closed casing 1 having inlet port 2 and outlet port 3. Supporting frame 4, which is disposed in closed casing 1, includes central hollow shaft 41 through which piston rod 13 extends, flange portion 42 protruding outwardly from the upper portion of central shaft 41, and a plurality of leg portions 43 extending downwardly from the peripheral portion of flange portion 42. Supporting frame 4 is attached to the inner surface of closed casing 1 by leg portions 43. Alternatively, supporting frame 4 can be elastically attached to the inner surface of closed casing 1 through a spring to absorb vibration.

Inner magnetic field core 8 is fixedly secured to and surrounds central shaft 41. Outer magnetic field core 9, having magnetic field coil 10 therein, surrounds inner magnetic field core 8 with a gap therebetween. Cylindrical magnets 11*a*, 11*b*, 11*c* are fixedly connected together and disposed in the gap between inner and outer magnetic field cores 8, 9. Inner and outer magnetic field cores 8, 9 and magnetic field coil 10 comprise a stator of a linear motor. Cylindrical magnets 11*a*, 11*b*, 11*c* collectively form a rotor 11 of a linear motor. Disc-shaped hub 12, which is U-shaped in cross section, is connected to the lower portion of rotor 11. Rotor 11 axially reciprocates when alternating current is supplied to magnetic field coil 10.

Piston rod 13 is slidably disposed in the axial bore of central shaft 41, and is connected to disc-shaped hub 12 at one end thereof. At its other end, piston rod 13 has piston 14 fixedly secured thereto. When rotor 11 reciprocates in response to the introduction of alternating current in magnetic field core 10, piston rod 13 and piston 14 axially reciprocate.

Piston 14 is slidably fitted in cylindrical member 15 which is disposed on flange portion 42 of supporting frame 4. A valve mechanism, fixedly disposed on the upper portion of cylindrical member 15, includes valve plate 18, suction valve 19 and discharge valve 20. Valve plate 18 includes suction hole 181 and discharge hole 182. Flange portion 42, cylindrical member 15, and the valve mechanism define a cylinder that forms the working chamber in which piston 14 reciprocates. The cylinder is divided on opposite sides of piston 14 into balance chamber 21 and compression chamber 22. Balance chamber 21 is defined by flange portion 42, cylindrical member 15, and piston 14. Compression chamber 22 is defined by cylindrical member 15, the valve mechanism, and piston 14. Groove 23, formed on the inner wall surface of cylindrical member 15, allows balance chamber 21 to communicate with compression chamber 22 when piston 14 passes thereover.

Cylinder head 24, attached to the top of valve plate 18, defines suction chamber 25 and discharge chamber 26. Suction chamber 25 and discharge chamber 26 are in fluid communication with compression chamber 22 through suction hole 181 and discharge hole 182, respectively. Cylinder head 24 includes two communication holes. First communication hole 28 establishes a fluid communication path between suction chamber 25 and inner chamber 27 of closed casing 1, and second communication hole 32 establishes a communication path between discharge chamber 26 and buffer chamber 31. Buffer chamber 31 is defined by annularly extending flange portion 29 of cylinder head 24, cylindrical portion 44 of supporting frame 4, and flange portion 42. Buffer chamber 31 is connected to outlet port 3 through connection tube 33.

Annular seal members 34 and 35 are disposed adjacent to the upper and lower portion of central shaft 41, respectively, to seal a gap between the outer surface of piston rod 13 and the inner surface of the axial bore of central shaft 41. Spring 36, disposed around the outer surface of piston rod 13 in balance chamber 21, assures that piston 14 remains separated from flange portion 42, and spring 37, disposed around the outer surface and lower end of piston rod 13, assures that hub 12 remains separated from the end of central shaft 41.

The free piston-type compressor as described above operates as follows:

Before the compressor is turned on, piston 14 is positioned over groove 23 as shown in FIG. 1. Consequently, compression chamber 22 communicates with balance chamber 21 through groove 23. When alternating current is supplied to magnetic field coil 10, piston rod 13 and piston 14 connected thereto reciprocate upwardly and downwardly.

When piston 14 moves upwardly in the cylinder, the volume of compression chamber 22 decreases, and the working gas in compression chamber 22 is compressed. The relatively high pressure compressed gas forces discharge valve 20 open as it flows into discharge chamber 26 through discharge hole 182. The gas in discharge chamber 26 then flows to buffer chamber 31, through connection tube 33, and out outlet port 3. As the volume of compression chamber 22 is decreasing on the upward stroke of piston 14, there is a corresponding increase in the volume of balance chamber 21. Consequently, the pressure in balance chamber 21 decreases. As a result, the pressure in balance chamber 21 is lower than the pressure in compression chamber 22. This pressure differential acts on the rear surface of piston 14. Spring 37 and the lower pressure in balance chamber 21 counterbalance the force of inertia of piston 14. Consequently, piston 14 does not contact valve plate 18.

When piston 14 moves downwardly in the cylinder, the volume of compression chamber 22 increases, and the pressure in compression chamber 22 decreases. When the pressure in compression chamber 22 drops below that in suction chamber 25, suction valve 19 opens, and the gas in suction chamber 25 enters compression chamber 22. The pressure in balance chamber 21 eventually becomes greater than the pressure in compression chamber 22. Accordingly the pressure in balance chamber 21, in conjuction with spring 36, counterbalance the force of inertia as piston 14 moves downwardly. Consequently, piston 14 does not contact flange portion 18.

Although the counterbalancing pressures on the opposite sides of piston 14 prevent it from colliding against valve plate 18 and flange portion 42 during operation of the compressor, it will be understood by those skilled in the art that piston 14 freely moves within cylinder member 15.

This invention has been described in detail in connection with one preferred embodiment. This embodiment, however, is merely for example only, and the invention is not intended to be restricted thereto. It will be understood by those skilled in the art that variations and modifications can be made within the scope of this invention as defined by the appended claims.

I claim:

1. A free piston type compressor comprising:

a piston slidably fitted within a cylinder;

a compression chamber defined in said cylinder at one end of said piston;

a balance chamber defined in said cylinder at the other end of said piston;

a piston rod connected to said piston and axially extending out of said cylinder through said balance chamber;

a valve mechanism including a suction valve, a discharge valve, and a valve plate, said suction valve and said discharge valve secured to said valve plate and said valve plate disposed on the end portion of said cylinder to face said compression chamber;

a reciprocation power production means for reciprocating said piston through said piston rod within said cylinder; and a cylinder head disposed on said valve plate, said cylinder head enclosing a suction chamber and a discharge chamber.

2. The free piston type compressor of claim 1 further comprising an annular buffer chamber surrounding said cylinder, said discharge chamber in communication with said buffer chamber through a fluid communication bore in said cylinder head.

3. The free piston type compressor of claim 2 further comprising an outlet port, said buffer chamber in fluid communication with said outlet port through a connection tube.

4. The free piston type compressor of claim 2 further comprising an inner chamber surrounding said buffer chamber and said cylinder head, said inner chamber in communication with said suction chamber through a fluid communication bore in said cylinder head.

5. A free piston type compressor comprising:

a piston slidably fitted within a cylinder;

a compression chamber defined in said cylinder at one end of said piston;

a balance chamber defined in said cylinder at the other end of said piston;

a piston rod connected to said piston and axially extending out of said cylinder through said balance chamber;

a valve mechanism including a suction valve, a discharge valve, and a valve plate, said suction valve and said discharge valve secured to said valve plate and said valve plate disposed on the end portion of said cylinder to face said compression chamber;

a reciprocation power production means for reciprocating said piston through said piston rod within said cylinder; and a supporting frame with a flange portion extending therefrom, a portion of said flange portion defining a bottom surface of said balance chamber.

6. The free piston type compressor of claim 5 further comprising a spring disposed in said balance chamber to surround said piston rod, said spring abutting said flange portion at one end and abutting said piston at the other end thereof.

7. The free piston type compressor of claim 5 further comprising a hollow central shaft extending from said flange portion, said piston rod extending through said hollow central shaft.

8. The free piston type compressor of claim 7 further comprising a seal between the mating surfaces of said hollow central shaft and said piston rod.

9. The free piston type compressor of claim 7 further comprising a rotor fixedly connected to said piston rod, and a spring disposed between said rotor and said hollow central shaft to maintain separation therebetween.

10. In a free piston type compressor including a piston slidably fitted within a cylinder, a compression chamber defined in said cylinder on one side of said piston, a balance chamber defined in said cylinder on the other side of said piston, a piston rod connected to said piston, a valve mechanism including a suction valve, a discharge valve and a valve plate, said suction valve and said discharge valve secured to said valve plate and said valve plate disposed on the end portion of said cylinder to face said compression chamber, and a reciprocation power production means for reciprocating said piston through said piston rod within said cylinder; the improvement comprising:

said piston rod axially extending out of said cylinder through said balance chamber; and a cylinder head disposed on said valve plate, said cylinder head enclosing a suction chamber and a discharge chamber.

11. The free piston type compressor of claim 10 further comprising an annular buffer chamber surrounding said cylinder, said discharge chamber in communication with said buffer chamber through a fluid communication bore in said cylinder head.

12. The free piston type compressor of claim 11 further comprising an outlet port, said buffer chamber in fluid communication with said outlet port through a connection tube.

13. The free piston type compressor of claim 11 further comprising an inner chamber surrounding said buffer chamber and said cylinder head, said inner chamber in communication with said suction chamber through a fluid communication bore in said cylinder head.

14. In a free piston type compressor including a piston slidably fitted within a cylinder, a compression chamber defined in said cylinder on one side of said piston, a balance chamber defined in said cylinder on the other side of said piston, a piston rod connected to said piston, a valve mechanism including a suction valve, a discharge valve and a valve plate, said suction valve and said discharge valve secured to said valve plate and said valve plate disposed on the end portion of said cylinder to face said compression chamber, and a reciprocation power production means for reciprocating said piston through said piston rod within said cylinder; the improvement comprising:

said piston rod axially extending out of said cylinder through said balance chamber; and a supporting frame with a flange portion extending therefrom, a portion of said flange portion defining a bottom surface of said balance chamber.

15. The free piston type compressor of claim 14 further comprising a spring disposed in said balance chamber to surround said piston rod, said spring abutting said flange portion at one end and abutting said piston at the other end thereof.

16. The free piston type compressor of claim 14 further comprising a hollow central shaft extending from said flange portion, said piston rod extending through said hollow central shaft.

17. The free piston type compressor of claim 16 further comprising a seal between the mating surfaces of said hollow central shaft and said piston rod.

18. The free piston type compressor of claim 16 further comprising a rotor fixedly connected to said piston rod, and a spring disposed between said rotor and said hollow central shaft to maintain separation therebetween.

19. A free piston type compressor comprising:

a piston slidably fitted within a cylinder;

a compression chamber defined in said cylinder at one end of said piston;

a balance chamber defined in said cylinder at the other end of said piston;

a piston rod connected to said piston and axially extending out of said cylinder through said balance chamber;

a valve mechanism including a suction valve, a discharge valve, and a valve plate, said suction valve and said discharge valve secured to said valve plate;

a reciprocation power production means for reciprocating said piston through said piston rod within said cylinder;

a spring disposed in said balance chamber to surround said piston rod; and a cylinder head disposed on said valve plate, said cylinder head enclosing a suction chamber and a discharge chamber.

* * * * *